United States Patent [19]

Artola

[11] Patent Number: 5,060,524

[45] Date of Patent: Oct. 29, 1991

[54] RACKET STRINGING TENSION MEASURING DEVICE

[75] Inventor: Felipe Artola, Vizcaya, Spain

[73] Assignee: Makser, S.A., Las Arenas-Getxo, Spain

[21] Appl. No.: 507,219

[22] Filed: Apr. 11, 1990

[51] Int. Cl.[5] ..... G01L 5/10; G01L 1/10

[52] U.S. Cl. ..... 73/862.41; 73/579; 73/651; 73/DIG. 1

[58] Field of Search ..... 73/862.41, 579, 581, 73/651, DIG. 1; 84/454, 456, 457, 459

[56] References Cited

U.S. PATENT DOCUMENTS 3,691,894 9/1972 Schneider et al. ..... 84/454
4,599,898 7/1986 Beer ..... 73/579

FOREIGN PATENT DOCUMENTS

WO8903709 5/1989 PCT Int'l Appl. ..... 73/862.41
148262 10/1959 U.S.S.R. ..... 73/862.41

*Primary Examiner*—Charles A. Ruehl
*Attorney, Agent, or Firm*—Browdy and Neimark

[57] ABSTRACT

A device to measure the tension of the stringing of rackets used for playing tennis, squash, etc. which entails an end area to strike the said stringing and another adjacent area which includes a multiple diapason or tuning device. On striking the stringing, and depending on the tension of the strings, one tooth of the multiple diapason vibrates, thus providing a signal which can later be measured or digitalized to provide a measurement of the tension of the stringing.

2 Claims, 1 Drawing Sheet

RACKET STRINGING TENSION MEASURING DEVICE

The invention deals with a device to measure the tension of the stringing of rackets, such as those used in tennis, squash, etc., so that a specific player can check whether the stringing tension of his racket or rackets is appropriate for the conditions in which he usually plays with them.

Every player who has a set of rackets knows the most suitable tension for each one of them, so that with this tension and with these rackets, his game develops to suit his needs. Knowing therefore the tension of one of his rackets, this player can in any way determine a measurement that corresponds with the said tension, and which is suitable for him.

For example, this measurement might be an acoustic impression, a physical impression, among others. By fixing this impression, whatever it might be, it would be possible to know immediately whether the stringing tension of the racket is suitable.

The invention claims a simple device which provides a perceivable and measurable measurement, which is related to the required tension of the stringing, so that a signal or measurement from the device corresponds to this tension.

Basically, a measuring device in accordance with the invention is made up of a long element with a rounded end, for example, and another that substantially corresponds with its own ends. Close to the rounded end, a multiple diapason or tuning device is placed, composed of a set of independent teeth, which are different and project out from the fixed base of the diapason. This diapason is firmly fixed by its base, from which the teeth rise freely. A simple blow of the rounded base of the measuring device on the racket stringing will immediately produce the vibration of one of the teeth of the multiple diapason, corresponding to the tension of the stringing.

The vibration of this tooth can be perceieved visually, for instance, and can be made to correspond with a graduated scale with numbers, signals, etc. When a racket is in suitable condition for a player, this signal shows the measurement required of the stringing tension. When the racket has been used for a time and the player wishes to check whether the tension is suitable, he can strike the racket again with the measuring device and if the tooth that vibrates is the same one, the racket is in the required condition.

If the tooth that vibrates is a different one, for instance a shorter one, the stringing tension is higher than required, and if the tooth that vibrates is longer, the stringing tension will be lower, which indicates to the player that he has to loosen or tighten the tension of the racket stringing. The multiple diapason is trapezoidal in shape, for example, with the teeth decreasing in height, so that only one tooth vibrates due to the effect of the blow on the racket stringing, and at the same time it must be easy to notice the tooth that vibrates so that it can be compared with the signal or mark on the measuring device.

According to the invention, and in accordance with what has been stated so far, the multiple diapason is of a certain size and can be made of plastic, metal, etc. The measuring device has one surface, at least, attached to the position of the multiple diapason which is equipped with a series of marks or signals corresponding to each tooth with a specific marking, so that the tooth that vibrates can be identified by reading the corresponding marking.

The invention also covers the possibility that the vibration of a specific tooth of the dispason can be suitably digitalized with the appropriate conventional equipment which is already known, thus automatically providing the desired measurement.

The vibration of one of the diapason teeth might also generate a perceivable acoustic signal, for example, so that this signal can also be digitalized.

These and other details of the invention can be seen better on the sheet of drawings which is attached, which shows a solution covered by the invention.

DESCRIPTION OF THE PREFERRED EMBODIMENT

Figure 1:
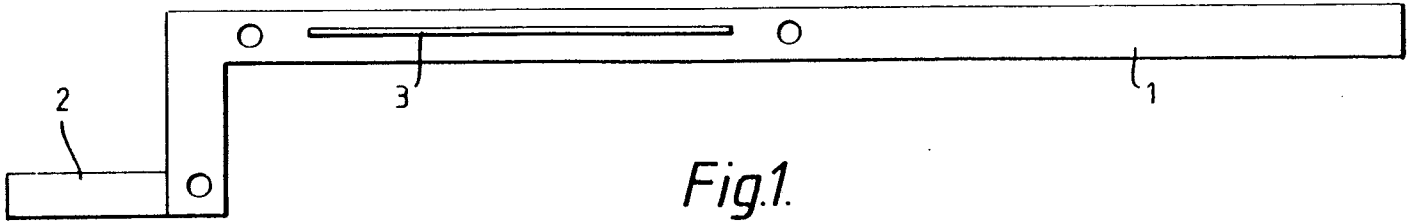
FIG. 1 shows a basic measuring device, in accordance with the invention.

In this particular case and in accordance with FIG. 1, a measuring device in accordance with the invention, is made up of a long U-shaped body, with one longitudinal end 1 and another rounded end 2 used to perform the striking or percussion on the racket stringing. The body of the measuring device has some lateral projections 3.

Figure 2:
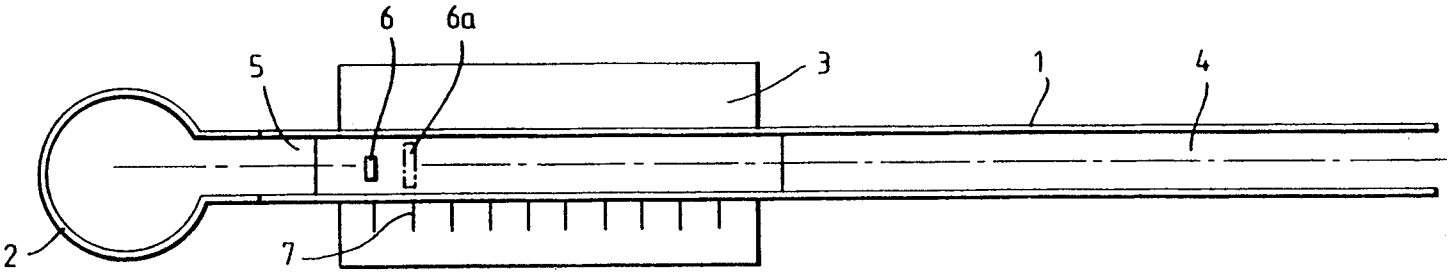
FIG. 2 shows a top view of the previous figure, with a multiple diapason housed inside the measuring device.

In accordance with FIG. 2, (the top view of FIG. 1), the two wings of the measuring device take in a multiple diapason 5 located just towards the zone where the lateral projections 3 are located. The diapason is fixed to the arms of the measuring device in a stable way by any means, for example screws.

The projections 3 are fitted with a series of marks or signals 7, which correspond to each one of the teeth 6 of the diapason. On the rounded end 2 making contact with the racket stringing, the vibration of one of the diapason teeth **6*a* is caused, with this being appreciable, for example visibly, while the rest of the teeth 6** remain static.

The player notices this vibration of the tooth **6*a* and relates it with the corresponding mark 7*a*. If this mark 7*a*** is the one which indicates the stringing tension required, it is clear that the stringing is adjusted to this needs. Otherwise, the stringing tension will need adjusting.

Figure 3:
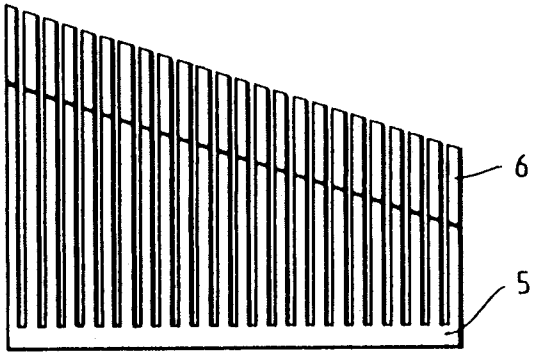
FIGS. 3 and 4 show an elevation of the diapason and a left side view respectively.
Figure 4:
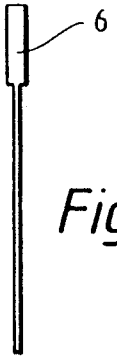

A multiple diapason or tuning device is shown in FIGS. 3 and 4 and is made up, in the form known, of a base 5 and a set of teeth 6 projecting to different heights or lengths, thus allowing a range of possibilities to be achieved.

Obviously, this is a simple solution for the invention and includes the spirit of what is claimed and the basic objectives pursued, although it must be well understood that this does not exclude any other variations or possibilities, among which is included the possibility of using different materials for the diapason and for the measuring device.

The solution shown is of very low cost and can be used immediately to control the stringing tension of a racket.

As was stated earlier, the application of this basic technique can be associated with a digitalized unit which might function operated by the physical vibration of the teeth or by the audible effect of this vibration, depending on the case.

I claim:

1. Racket stringing tension measuring device, having an elongated element with a rounded end to strike the stringing and another end in the form of a handle, in that in the proximity of the said rounded end is fitted a multiple diapason equipped with several teeth, in that one of these teeth vibrates due to the effect of striking the stringing with the rounded end of the measuring device depending on the stringing tension and in that this vibration can be checked to provide a measurement of the tension of the said stringing with means which are contained in the measuring device.

2. Racket stringing tension measuring device, in accordance with claim 1, wherein the vibration of one of the teeth can be perceived visually, and wherein each tooth corresponds to a graduated scale of the device to measure the tension depending on the tooth which vibrates.

* * * * *